United States Patent [19]

Thatcher

[11] Patent Number: 4,650,096

[45] Date of Patent: Mar. 17, 1987

[54] MOLDED CONTAINER WITH INTEGRAL SPOUT

[76] Inventor: Alan J. Thatcher, 9182 E. Russell St., La Habra, Calif. 90631

[21] Appl. No.: 652,274

[22] Filed: Sep. 20, 1984

[51] Int. Cl.[4] ..... B65D 17/28; B65D 25/44

[52] U.S. Cl. ..... 222/153; 222/525; 222/538; 222/541

[58] Field of Search ..... 222/143, 153, 522, 525, 222/530, 541, 566, 570; 220/855 P, 266, 307

[56] References Cited

U.S. PATENT DOCUMENTS

| | | | |
|---|---|---|---|
| 3,128,900 | 4/1964 | Chaboche | 222/541 UX |
| 3,326,421 | 6/1967 | Peace | 222/143 |
| 3,493,146 | 2/1970 | Conners et al. | 222/153 |
| 3,603,485 | 9/1971 | Vivier | 222/570 X |
| 3,659,757 | 5/1972 | Tini | 222/525 X |
| 4,019,663 | 4/1977 | Krautkramer | 222/541 X |
| 4,076,151 | 2/1978 | Littlefield | 222/525 |
| 4,171,749 | 10/1979 | Obrist et al. | 222/541 X |
| 4,264,022 | 4/1981 | Perné et al. | 222/570 X |
| 4,351,455 | 9/1982 | Bond | 222/522 X |
| 4,452,382 | 6/1984 | von Holdt | 222/541 X |

FOREIGN PATENT DOCUMENTS

| | | | |
|---|---|---|---|
| 1562177 | 2/1969 | France | 222/541 |

*Primary Examiner*—Joseph J. Rolla
*Assistant Examiner*—Frederick R. Handren
*Attorney, Agent, or Firm*—Edgar W. Averill, Jr.

[57] ABSTRACT

A molded plastic container includes a one-piece bottom portion having a cylindrical mouth and a one-piece top portion having an extendable center spout and raised neck. The spout is held within the neck and moveable between extended and retracted positions. The container is filled through the cylindrical mouth after which the top and bottom portions are non-removeably joined. Initially, the spout, neck and cap are joined by a removeable tear-off ring which seals the container. Once the tear-off ring is removed, the spout is free to move between extended and retracted positions, and the cap may be placed on the neck to hold the spout in its retracted position and reseal the container.

13 Claims, 7 Drawing Figures

MOLDED CONTAINER WITH INTEGRAL SPOUT

BACKGROUND OF THE INVENTION

This invention relates generally to commercial liquid containers and particularly to those molded of plastic material which are intended to be disposable and used for commercial distribution of liquids such as engine lubricating oil and the like.

Many liquid products such as cleansers, solvents and lubricating oils share a common method of manufacture, distribution and sale in that they are typically produced in bulk quantities and then packaged for sale to the consumer in small individual containers. The operation of filling the individual consumer containers with the bulk produced liquid is generally a fully automated operation in which the containers are sequentially passed through a filling station in which a group of downwardly projecting filler nozzles directs the liquid into the containers through upwardly facing container apertures.

One of the most common products so manufactured, marketed and distributed is engine lubricating oil which is processed in bulk quantities and usually packaged for sale in one quart containers. While the overwhelming majority of consumer containers for engine lubricating oil are of either one liter or one quart in volume, there has been a recent trend to also package and sell lubricating engine oil in four or five quart containers. In either event, the efficiency demands of the market place dictate that the container used be capable of easy and rapid filling and preferably be capable of multiple stacking in order to reduce shipping and storage costs. To date, these needs have for the most part been met with some success by the familiar one quart metal oil can which has a metal cylindrical container with flat top and bottom metal surfaces. To reduce weight and material costs, a hybrid container is widely used in which the top and bottom flat surfaces remain metal but the cylindrical side walls are made of a foil-coated pressed paper or cardboard material. Such containers are more subject to leakage than the all metal cans.

In either case, the packaging process essentially comprises initially combining the metal bottom metal portion and the side wall together and passing the can (minus its top) through the filling station of the process. Subsequently, the filled can is passed through a top assembly operation in which the metal top is attached by crimping or folding completing the sealing of the container. The familiar "oil can" container has persisted despite several disadvantages due primarily to the rapid filling made possible by the wide aperture offered by the can before its top is applied and the convenience of stacking offered by the flat, bottom and top surfaces of the oil cans.

Despite these two advantages, there remain, however, several disadvantages to the conventional oil can. For example, a special opener is required to remove the liquid from the can. Further, the construction is a three piece fabrication which results in a plurality of seams. This increases the possibility of leakage and greatly weakens the can's structure. The latter is particularly true in the case of the particle material side wall version of the can. In its most common use, that is, automotive engine lubricating oil, the small aperture through which engine oil is added to the crank case necessitates the use of a separate spout or funnel to avoid spilling.

These and other disadvantages of the commonly used oil can have spawned a great number of structures which include the use of a snap-on, reusable funnel which the consumer attaches to the upper side walls of the can once the can has been opened. Another structure uses a plastic bottle-like molded container in which the container top includes in a funnel shaped portion and an extending neck structure. In the latter case, a twist-off cap is also generally used to seal the neck.

While these structures provide some improvement in the consumer needs of easy access and resealability, the need for snap on funnels increases expense to the consumer and the molded containers with integral funnel and neck have the concomitant disadvantage of necessitating that fluid filling take place through the much smaller neck orifice of the container. This, of course, increases filling time and costs. Furthermore, such containers are usually impossible to stack for retail display and storage.

There remains therefore a need in the art for an inexpensive container which may be filled quickly, provides an integral pouring spout and is resealable and stackable.

SUMMARY OF THE INVENTION

In accordance with the present invention, there is provided a two-piece molded container in which the first piece is a generally cup-like container having side wall surfaces and bottom surface and defining a top aperture of substantially the same size as the side wall dimensions, and a second molded piece formed of a single molded unit including means for non-removably mating with the top aperture of the first piece. The means for non-removably mating the top with the container has a groove formed between an inner rim member and an outer wall member. This groove holds a central rim which is locked in the groove by the entry of a snap ridge held in a circular recess. The top has four integral members molded in a single continuous piece in which one of the members is common to all three of the remaining members and is separable therefrom by a tear-off operation. Once the tear-off piece has been removed, the remaining three members comprise a top surface, a spout movable between a retracted position and an extended position relative to the top surface, and a cap. The cap is removably mateable with the top surface when the spout is in a retracted position and, when so mated, holds the spout with respect to the top surface in the retracted position and seals the container.

BRIEF DESCRIPTION OF THE DRAWINGS

The Figures of the present invention which are believed to be novel are set forth with particularity in the appended claims. The invention, together with further objects and advantages thereof, may best be understood by reference to the following description taken in conjunction with the accompanying drawings in the several figures of which like reference numerals identify like elements, and in which:

DESCRIPTION OF THE PREFERRED EMBODIMENTS

Figure 2:
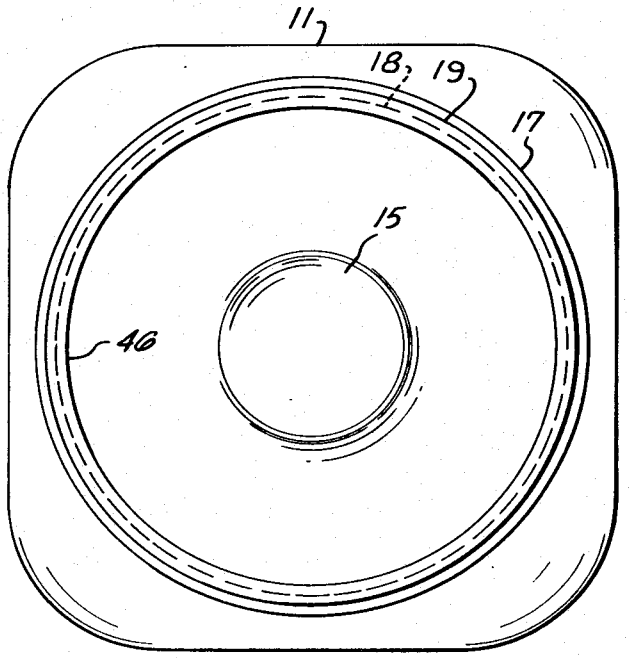
FIG. 2 is a plan view of the container of FIG. 1.
Figure 1:
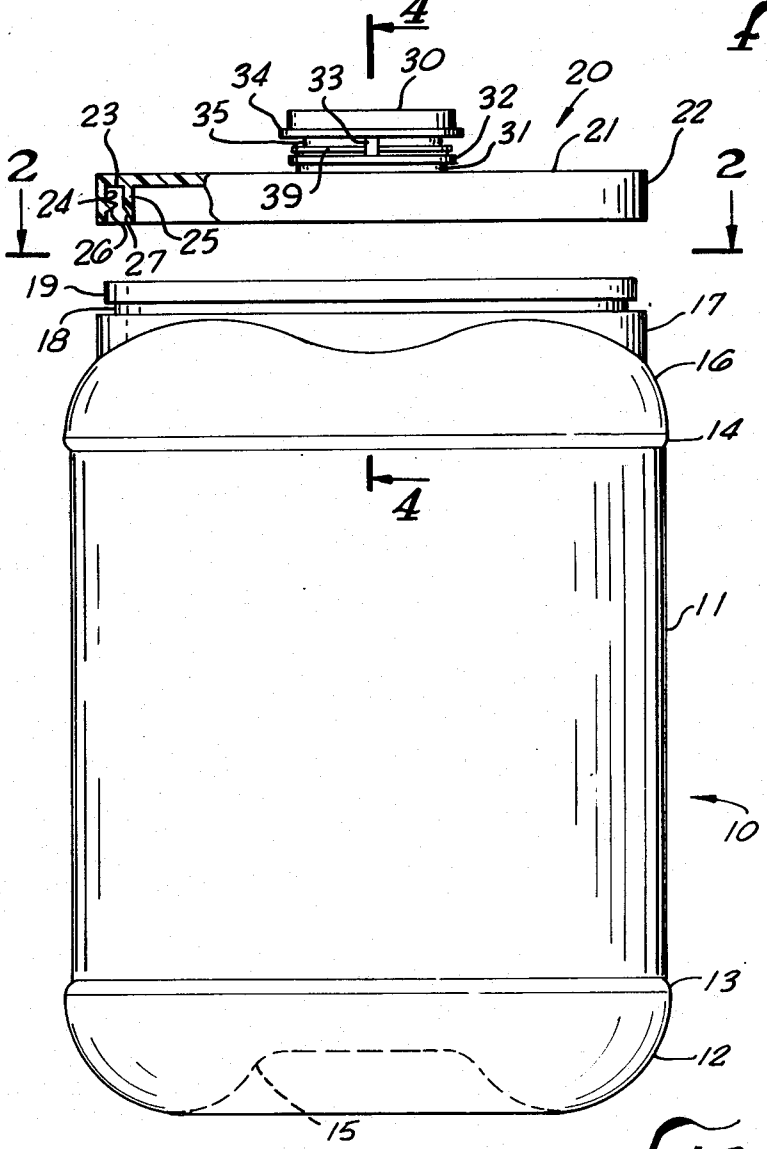
FIG. 1 is a partially exploded elevation view of a container constructed in accordance with the present invention.

FIG. 1 shows the present invention container having a container bottom generally referenced by the numeral 10 and a top member generally referenced by the number 20. Container bottom 10 comprises a vertical side wall 11 resting upon a bottom 12 which is attached to side wall 11 by an integral ridge 13. Bottom 12 further defines a concave recess 15 generally centered within bottom 12, the importance and function of recess 15 will be described below in greater detail. Container bottom 10 further includes a ridge 14 joined to side wall 11 and a transition member 16 connected to an upper wall 17. As can be seen by reference jointly to FIGS. 1 and 2, side wall 11 has a generally square cross-section with rounded or filleted corners while upper wall 17 has a round cylindrical configuration. For this reason, transition member 16 is formed to provide a continuous surface between the more or less square shape of side wall 11 and the round cylindrical configuration of upper wall 17. Upper wall 17 further includes a rim 19 having a diameter slightly smaller than that of upper wall 17 and an inter-spaced groove 18 which in turn has a diameter less than both upper wall 17 and rim 19.

Figure 3:
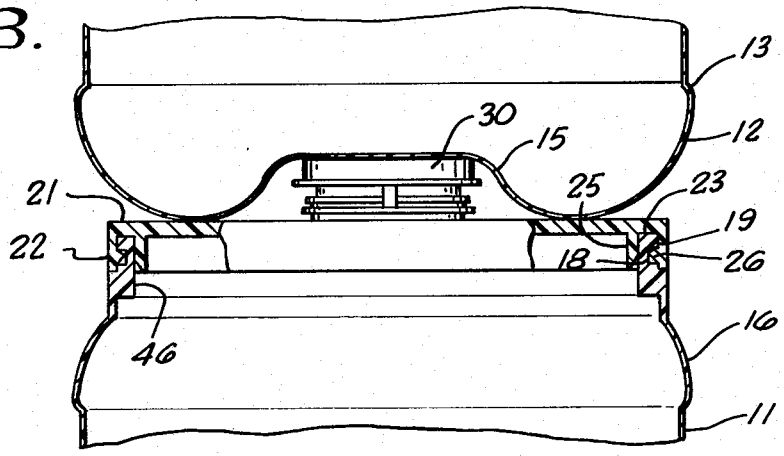
FIG. 3 is a partially sectioned view of the interface between respective tops and bottoms of the present invention containers.
Figure 7:
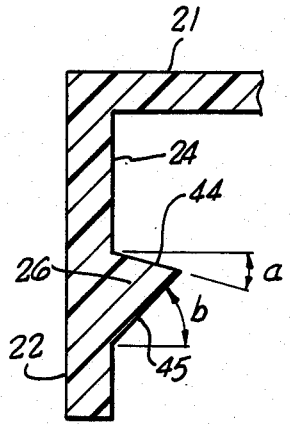
FIG. 7 is an enlarged cross-sectional view of the outer wall of the upper portion of the container of the present invention.

Top member 20 includes a cylindrical outer wall 22 and an upper surface 21 of generally flat configuration. Outer wall 22 and upper surface 21 are of circular configuration. In addition, outer wall 22 has an outer diameter approximately equal to that of upper wall 17 and an interior wall 24 which provides a smooth outer surface at the interface of the top 20 and the bottom 10 as shown in FIG. 3. Top member 20 further defines a circular interior rim 25 concentric with outer wall 22 and extending downwardly from the underside of upper surface 21 and terminating in an inclined surface 27. Top member 20 further defines a groove 23 concentric with outer wall 22, between wall 24 and rim 25. A snap ridge 26 extends inwardly from wall 24 of top member 20 and extends along the entire surface of wall 24. The shape of snap ridge 26 is shown in enlarged cross-sectional view in FIG. 7. Ridge 26 has an upper surface 44 which is at an angle "a" with respect to the horizontal. The bottom or lower surface 45 of ridge 26 is at an angle "b" with respect to the horizontal. Angle "a" is preferably between 5 and 25 degrees and ideally about 15 degrees. By the use of an angle in this range, the top will be securely held onto the bottom while still being able to snap into place when pushed onto the bottom. Angle "b" is less critical but ideally is about 45 degrees.

Top member 20 further defines a neck 31 centered on upper surface 21 with respect to outer wall 22 and a neck rim 32 extending outwardly a short distance beyond neck 31. Top member 20 further defines a cap 30 and a cap rim 34, the construction of which will be set forth below in greater detail. A tear-off ring 35 joins cap 30, spout rim 39 and neck rim 32.

While many features and aspects of the present invention are set forth below in greater detail, suffice it to say in connection with FIG. 1 that bottom container 10 and top member 20 are shown in partially exploded view prior to assembly of top member 20 upon container bottom 10. In the situation shown with reference to the above-described sequence of manufacture and filling for fluid merchandising above, once container bottom 10 has been filled, top member 20 is positioned overlying upper walls 17, groove 18 and rim 19 of container bottom 10, and is simply lowered to a position in which snap ridge 26 contacts rim 19 and incline 27 of rim 25 rests upon the interior surface of mouth 35 (shown in FIG. 2). Thereafter, a simple downward force, completes assembly. Top member 20 is pressed downwardly upon rim 19 causing rim 19 to spread incline 27 and rim 25 inwardly (away from wall 24) and to spread wall 24 away from rim 19 permitting snap ridge 26 to move across the outer surface of rim 19 and top member 20 to move downwardly bringing outer wall 22 closer to upper wall 17. At the point of travel in which rim 19 has moved into groove 23 a sufficient distance for snap ridge 26 to overlie groove 18 of upper wall 17, snap ridge 26 is urged into groove 18 and captivates rim 19 within groove 23 and the interior surface of rim 25. The resulting assembly will be set forth below and described in greater detail in the accompanying figures. However, suffice it to say here that what has been carried forth is a single one-step assembly in which container bottom 10 and upper surface 21 are irremovably assembled and in which snap ridge 26, groove 23, and rim 25 captivate rim 19 against wall 24 and maintain a compression fit to assure proper sealing of the resulting container enclosure.

As set forth above and in accordance with an important aspect of the present invention, the two piece construction of the present invention container permits rapid filling of container bottom 10 through the large aperture presented by mouth 46 comparable in efficiency with the traditional oil can. Furthermore, the easy assembly of top member 20 to bottom container 10 produces a sealed integral structure with only a single seam and virtually no assembly costs. Top member 20 is depicted in FIG. 1 as it would appear prior to opening by the consumer. The combined structure of cap 30, neck 31 and neck rim 32 together with tear-off ring 35 and tab 33 extends above upper surface 21 a relatively small distance.

The importance of this short extension of the neck and cap structure depicted in FIG. 1 is better understood by reference to FIG. 3 in which the cap, neck, and tear-off ring structure of FIG. 1 is repeated and in which there is shown a similar container stacked upon upper surface 21 of top member 20. It is important to note that recess 15 in the top container permits bottom 12 thereof to rest upon upper surface 21 of the lower container. Further, recess 15 extends upwardly into container bottom 10 far enough that cap 30 does not touch recess 15. In other words, prior to removal of tear-ring 35, that is consumer opening, the present invention containers may be stacked in multiple vertical levels. In addition, the cooperation of recess 15 of the upper container and the protruding portions formed by cap 30, tear-off ring 35 and neck 31 of the lower container cooperate to provide nested stacking of the present invention containers in which the alignment of stacked containers is maintained and sliding of bottom 12 of the upper container across upper surface 21 of the lower container is minimized.

The partially sectioned portions of top member 20 shown in FIG. 3 show the combined structure, described above, after top member 20 has been joined to container bottom 10. As mentioned above and shown clearly in FIG. 3, once joined by the foregoing method, container bottom 10 and top member 20 are mated irremovably and maintained in a sealed position by the intrusion of snap ridge 26 into groove 18 and the outward urging of rim 25 against rim 19. As can be seen, the resulting structure provides a single container seam having substantial certainty of proper sealing between top member 20 and container bottom 10, and a strong container structure.

Figure 4:
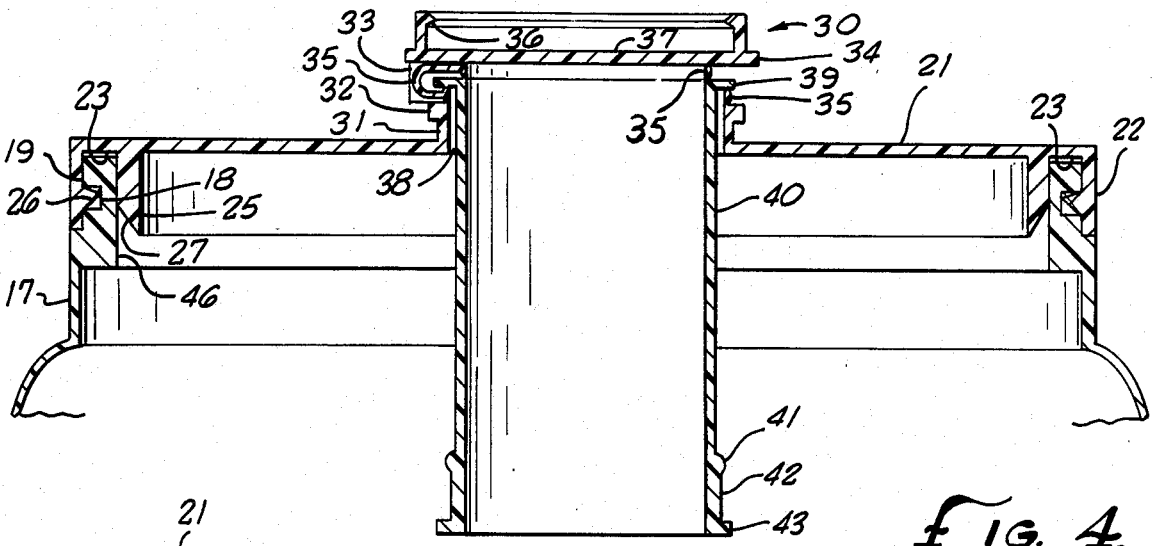
FIG. 4 is a section view of a portion of the present invention container taken along the section line 4—4 of FIG. 1.

Turning now to FIG. 4 in which a full section view of the upper portion of the present invention container in the assembled position is shown. The details of the above-described assembled structure of rim 19 resting within groove 23 and being maintained by the combined actions of rim 25 and snap ridge 26 are repeated. In addition and in accordance with an important aspect of the present invention, top member 20 is formed of a single molded component. Outer wall 22 and upper surface 21 form the container top and top member 20 further defines a circular neck portion 31 which terminates in an outwardly extending neck rim 32 the reasons for which are set forth below. Top member 20 further defines a spout aperture 38 which for reasons described below in greater detail and has a diameter slightly greater than spout 40. Top member 20 also defines a cap 30 which includes a cap surface 37 and a cap sealing rim 36 together with a cap rim 34. As can be seen by examination of FIG. 4 and briefly turning to FIG. 6, cap 30 is, prior to removal of tear-off ring 35, in essence resting in an inverted position from its normal relationship to neck 31 and neck rim 32 when the present invention container is resealed. Returning now to FIG. 4, top member 20 further includes a circular cross-section elongated spout 40 which terminates at its upper end in an extended spout rim 39 and at its lower end in a stop ring 43 both of which extend outwardly from spout 40. The lower end of spout 40 also defines a snap ridge 41 and a seating wall 42 between snap ridge 41 and stop ring 43. Snap ridge 41 has a diameter slightly greater than that of spout 40. The importance of this increased diameter will be set forth below in greater detail. As is shown in FIG. 4 and mentioned above, spout 40, cap 30, upper surface 21, tear-off ring 35 and tab 33 are all formed of a single piece of molded plastic material. It should also be noted that tab 33 and tear-off ring 35 are the only members having common surfaces between cap 30, spout rim 39 and neck rim 32. This construction is in accordance with an important aspect of the present invention. As configured in FIG. 4, the entire assembly of cap 30, spout 40, tear-off ring 35 and neck 31 presents a one piece sealed structure in which fluid is sealed within the container and in which spout 40 is maintained in its retracted position. In other words, the present invention container top member 20 is molded of a single piece of plastic material and is shown in FIG. 4 in the configuration which would be presented to the consumer upon receiving the filled container with its seal intact. Tear-off ring 35 forms a flat ribbon which surrounds the top of sprout 40 and which is removable by pulling on tab 33. In order to open the present invention container and gain access to the liquid contained therein, the consumer need only grasp tab 33 and pull it causing tear-off ring 35 to simultaneously separate from neck rim 32, spout rim 39 and cap rim 34 of cap 30. With this separation, spout 40, neck 31 of upper surface 21 and cap 30 are mutually separated one from the other permitting spout 40 to be drawn to its extended position.

Figure 5:
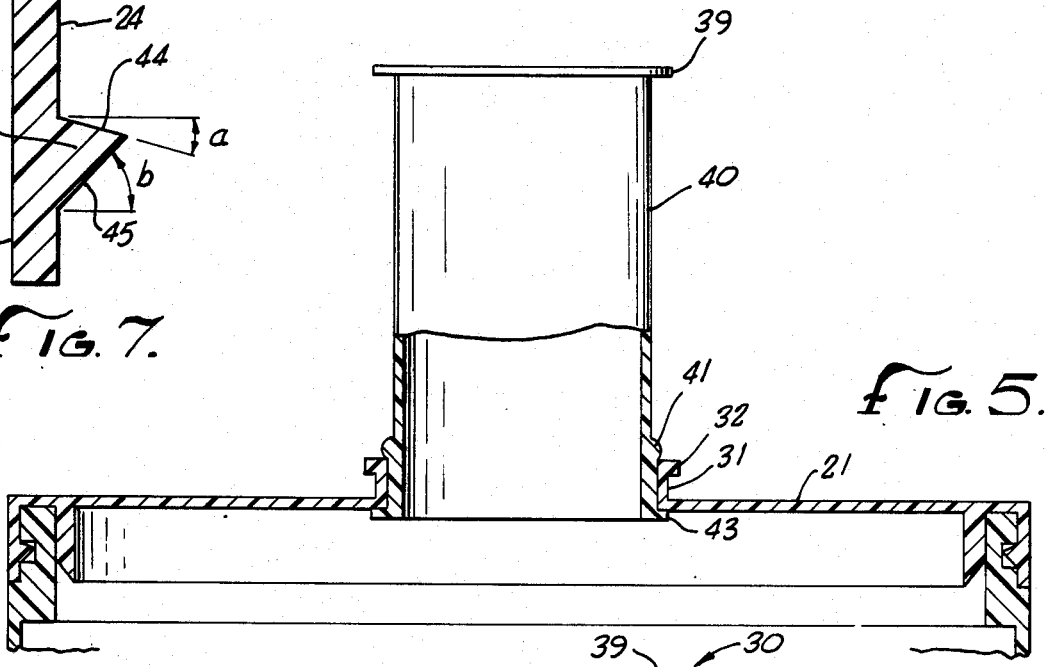
FIG. 5 is a partially sectioned view of the top portion of the present invention container with the spout extended.

FIG. 5 is a partially sectioned view of the upper portion of the present invention container as it appears just after tear-off ring 35 and tab 33 have been removed from the structure shown in FIG. 4 and after spout 40 has been pulled to its extended position. During movement of spout 40 to its extended position, snap ridge 41 is pulled through spout aperture 38 until it passes above neck rim 32. While snap ridge 41 is larger than spout aperture 38, the elasticity of neck 31 and neck rim 32 permits them to expand allowing the larger diameter snap ridge 41 to pass through spout aperture 38. Once snap ridge 41 emerges from spout aperture 38, neck rim 32 and neck 31 close around seating wall 42 of spout 40. As mentioned above, seating wall 42 is a larger diameter than spout 40. This produces a seal between aperture 38 and sealing wall 42. Complete withdrawal of spout 40 from the present invention container is precluded by the extended surface of stop ring 43 which abuts the underside of upper surface 21 and is large enough to preclude passage through aperture 38. Thus, the structure in FIG. 5 shows spout 40 extended and maintained in its extended position by the combined actions of snap ridge 41 and stop ring 43 captivating neck rim 32 and neck 31.

At this point, the consumer may tip the container to an inverted or inverted and inclined position and pour the desired amount of liquid from the container interior into the filler orifice of the automobile engine or any other desired receptacle. In the event the entire contents of the present invention container are not emptied out, the consumer may retract the container spout by simply forcing spout 40 downward with respect to upper surface 21. This causes snap ridge 41 to force neck rim 32 and neck 31 outwardly and to pass through spout aperture 40. Once snap ridge 41 clears spout aperture 38, spout 40 will easily move downwardly until spout rim 39 rests upon neck rim 32.

Figure 6:
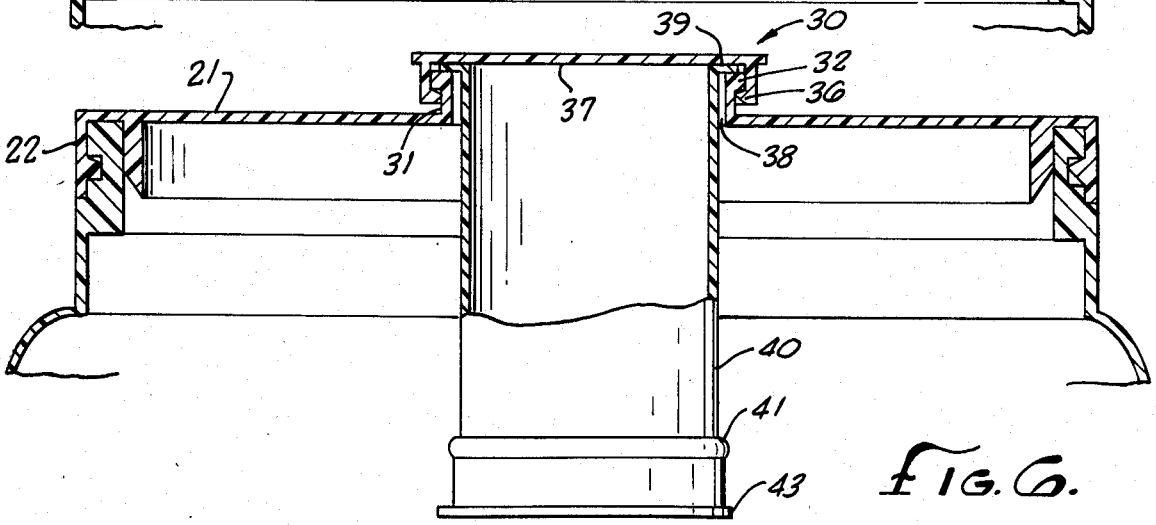
FIG. 6 is a partially sectioned view of the upper portion of the container of the present invention in which the spout is retracted and the sealing cap is assembled.

Closure of the container is best understood by turning to FIG. 6 which shows the relative positions of spout 40 and top member 20 once spout 40 has been pushed all the way down to its retracted position and spout rim 39 rests upon neck rim 32. At this point, the consumer may reseal the present invention container by simply taking cap 30 and inverting it from its original position and placing it such that cap sealing rim 36 overlies neck rim 32. Thereafter, a downward force upon cap 30 will cause cap sealing rim 36 to slide over neck rim 32 and rest against neck 31. As a consequence, cap 30 is maintained by the resilient action of cap sealing rim 36 captivating neck rim 32. In addition, because spout ring 39 lies between neck rim 32 and cap surface 37 of cap 30 when spout 40 is retracted fully, the resilient grasp of cap sealing ring 36 upon neck rim 32 maintains a compression force upon spout ring 39 captivating it between cap surface 37 and neck rim 32. This compressive captivation of spout ring 39 accomplishes an important aspect of the present invention in which the resealed configuration shown in FIG. 6 forms a reliable liquid-tight seal which may be repeatedly opened and resealed.

The inventive structure shown embodies a structure using a rigid spout member which is moved between an extended and retracted position. It will be apparent to those skilled in the art, however, that equivalent structures for extending and retracting such a spout may be substituted without departing from the spirit and scope of the present invention. For example, rather than the rigid slideable member shown, spout member 40 may instead be a deformable member in which a continuous accordian-like wall extends from the bottom of the spout member to the adjoining portions of the upper container.

What has been shown is a molded plastic container suitable for use in storing, distributing and merchandising liquid material in which a resealable inexpensive container is formed.

Further, it will be apparent to those skilled in the art from the foregoing disclosure that the present invention container described herein has numerous advantages. For example, the entire structure of top member 20 including spout 40, cap 30 and neck 31 and upper surface 21 together with tear-off ring 35 are formed of a single continuous molded piece which upon removal of the tear-off ring is divided into several separate members. This structure is extremely advantageous in mass distribution of liquids such as engine oil in which the ease of consumer opening of the container and the reliability of the seal prior to distribution to the consumer is of great concern. Further, the container of the present invention, because of its two-piece structure, permits the rapid filling of container bottom 10 through the large orifice of mouth 46 rather than through the smaller orifice of spout 40. This, of course, produces a container which may be quickly and efficiently filled thereby meeting manufacturers' needs and which once assembled by simple snap-type operation then presents to the consumer all the advantages of easy pouring etc. available in the prior art structures in which a funnel neck is provided.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A molded container comprising:

a one piece molded vessel having a bottom surface and side walls extending therefrom to form an interior cavity, and a mouth aperture;

a one piece molded top defining a substantially planar portion defining first and second surfaces and an outer periphery, a raised neck extending from said first surface and terminating in a neck aperture, an outwardly extending neck rim surrounding said neck aperture, a neck passage passing through said neck and said planar portion, and a side wall encompassing said outer periphery and extending away from said second surface substantially perpendicular thereto in the direction opposite to said neck, said side wall including mating means cooperating with said mouth aperture for attaching said one piece molded top to said molded vessel;

an elongated spout, having first and second ends and a central passage therethrough, said elongated spout extending through and moveable within said neck aperture and said neck passage and having a cross section and size substantially similar to said neck aperture and defining first and second stop rims at each of said first and second ends extending outwardly from said central passage, and snap means cooperating with said neck passage for securing said spout in an extended position in which said spout extends beyond said neck;

a cap having a planar surface and side walls substantially perpendicular thereto defining a cap cavity and a cap snap ring extending inwardly from said side walls into said cap cavity; and a tear-off ring, joined to said one piece molded top, said elongated spout and said cap, defining interfaces therebetween;

said one piece molded top, said elongated spout, said cap and said tear-off ring being molded in a single molded unit in which said tear off ring is the sole member joining said molded top, said elongated spout and said cap and is removable therefrom by tearing along said interfaces.

2. A molded container as set forth in claim 1 wherein said mouth aperture defines a wall portion having inner and outer surfaces, and a groove extending about said outer surface of said wall portion and wherein said mating means include a snap ridge extending inwardly from said side wall and a rim extending away from said second surface and spaced from said side wall a distance approximately equal to the thickness of said wall portion of said mouth aperture.

said mouth aperture non removeably mating with said molded top by insertion of said wall portion between said side wall and said rim to the point at which said snap ridge extends into said groove.

3. A molded container as set forth in claim 2 wherein said spout is captivated within said neck passage and is moveable between extended and retracted positions.

4. A molded container as set forth in claim 3 wherein said snap means includes a raised bead extending from the outer surface of said spout, said raised bead having an outer dimension greater than said neck passage interior and spaced from said second stop rim a distance about the same as the length of said neck passage.

5. A molded container as set forth in claim 4 wherein said spout defines a raised sealing wall between said second stop rim and said raised bead.

6. A molded container as set forth in claim 5 wherein said tear-off ring is joined to said molded top at said neck rim.

7. A molded container as set forth in claim 6 wherein said mouth aperture, molded top periphery, neck, neck passage, spout, and cap are each of circular cross section and mutually concentric.

8. A molded container as set forth in claim 7 wherein said cap, once separated from said tear-off ring, may be forced over said neck rim such that said neck rim and said cap snap ring cooperate to captivate said first stop rim of said spout and seal said interior cavity.

9. A molded container as set forth in claim 8 wherein said bottom surface defines a recess extending into said interior cavity to permit said molded container to be stacked upon another similarly constructed container.

10. A molded container as set forth in claim 9 wherein said tear-off ring includes a flat ribbon portion and an outwardly extending tab projection.

11. A molded liquid container having top, bottom and side surfaces forming an enclosure wherein said top includes a raised cylindrical neck terminating in a neck rim; a cylindrical spout, maintained within said neck and moveable between an extended position in which a major portion of said spout extends beyond said neck and a retracted position in which a major portion of said spout extends into said enclosure; a cap defining a cavity configured to enclose and engage said neck rim; and a tear-off ring joined to said neck, said cap and said spout in a single molded piece.

12. A molded liquid container as set forth in claim 11 wherein said tear-off ring is separatable from said neck, cap and spout such that said neck, cap and spout become separate disconnected members.

13. A molded liquid container as set forth in claim 12 wherein said top and side surfaces are separated by a seam which includes cooperating mating means permitting said container to be filled with said seam separated and sealed by joining said seam.

* * * * *